United States Patent [19]

Susich

[11] 4,276,992

[45] Jul. 7, 1981

[54] DRINKING CUP WITH LATERALLY ACTUATED VALVE

[76] Inventor: Roland J. Susich, 3518 Bayberry La., Malibu, Calif. 90265

[21] Appl. No.: 17,494

[22] Filed: Mar. 5, 1979

[51] Int. Cl.[3] ..... A47G 19/22

[52] U.S. Cl. ..... 220/254; 220/90.4; 220/264; 222/470; 222/518

[58] Field of Search ..... 220/90.2, 90.4, 254, 220/264; 222/469, 470, 472, 473, 556, 474, 509, 518, 511

[56] References Cited

U.S. PATENT DOCUMENTS

| | | | |
|---|---|---|---|
| 93,785 | 8/1869 | Wolf | 222/511 |
| 118,860 | 9/1871 | Kent | 222/470 X |
| 1,380,973 | 6/1921 | Kelseg | 222/470 X |
| 2,154,346 | 4/1939 | Mills | 222/566 X |
| 2,187,927 | 1/1940 | Arotte | 222/470 |
| 2,229,303 | 1/1941 | Peterson | 222/470 |
| 2,516,513 | 7/1950 | Gall, Jr. | 222/470 |
| 2,636,647 | 4/1953 | Covitt et al. | 222/470 |
| 2,799,437 | 7/1957 | Jepson | 222/470 |
| 3,059,817 | 10/1962 | Tregoning | 222/470 |
| 3,396,876 | 8/1968 | Workman et al. | 222/474 |
| 3,847,311 | 11/1974 | Flores et al. | 220/90.4 |
| 3,964,631 | 6/1976 | Albert | 220/90.4 |
| 3,967,748 | 7/1976 | Albert | 220/90.4 |
| 3,972,443 | 8/1976 | Albert | 220/264 X |
| 4,094,433 | 6/1978 | Numbers | 220/90.4 |
| 4,099,642 | 7/1978 | Nergard | 220/90.4 |
| 4,133,446 | 1/1979 | Albert | 220/90.4 |

*Primary Examiner*—Allan N. Shoap
*Attorney, Agent, or Firm*—Donald D. Mon

[57] ABSTRACT

A drinking cap is described having a removable sealed cup with a laterally actuated valve operated by an actuator adjacent to the handle of the cup. Fluid retained in the cup by the cap can be poured out when the valve is actuated by the thumb. The top of the cap provides a reservoir having a canted surface for collection of any fluid in the cap around the valve. The valve actuator is correctly positioned adjacent to the handle of the cup by a bayonet-type lock.

4 Claims, 5 Drawing Figures

DRINKING CUP WITH LATERALLY ACTUATED VALVE

BACKGROUND OF THE INVENTION

This invention relates to drinking cups generally and more particularly relates to a sealed insulated drinking cup having a laterally actuated valve for allowing fluid to leave the cup.

Insulated drinking cups are known, as are insulated containers such as vacuum bottles for hot or cold fluid. Vacuum bottles having caps which seal the contents to prevent them from spilling are also known. Drinking cups (sometimes called "steins") having a thumb operated flip open lid are also known, but they do not seal the contents of the cup. Also, drinking cups are known which have push-down actuators similar to those on a stein for opening a valve in the lid closure.

The known arrangements are relatively inconvenient to use, and can be rather inadvertently actuated. It is an object of this invention to provide a non-spill cup whose valve is laterally actuated, and less liable to be opened accidentally.

The purpose of the present invention is to provide a sealed, preferably insulated, drinking container allowing outflow of its contents through an easily operated laterally actuated valve which closes to prevent spilling when not opened, and whose cap can be removed. The present invention provides a container having a removable cap to retain the contents. The cap includes a side actuated valve for allowing contents to flow out, which is easily operated by the thumb. The cap is provided with ridges or shoulders angled to engage ridges on the outside periphery of the cup to automatically position the valve actuator on the side adjacent to a handle on the cup when the cap is installed on the cup.

The advantages and novel features of the invention will become more apparent when considered in conjunction with the accompanying drawings in which.

DESCRIPTION OF THE PREFERRED EMBODIMENT

Figure 1:
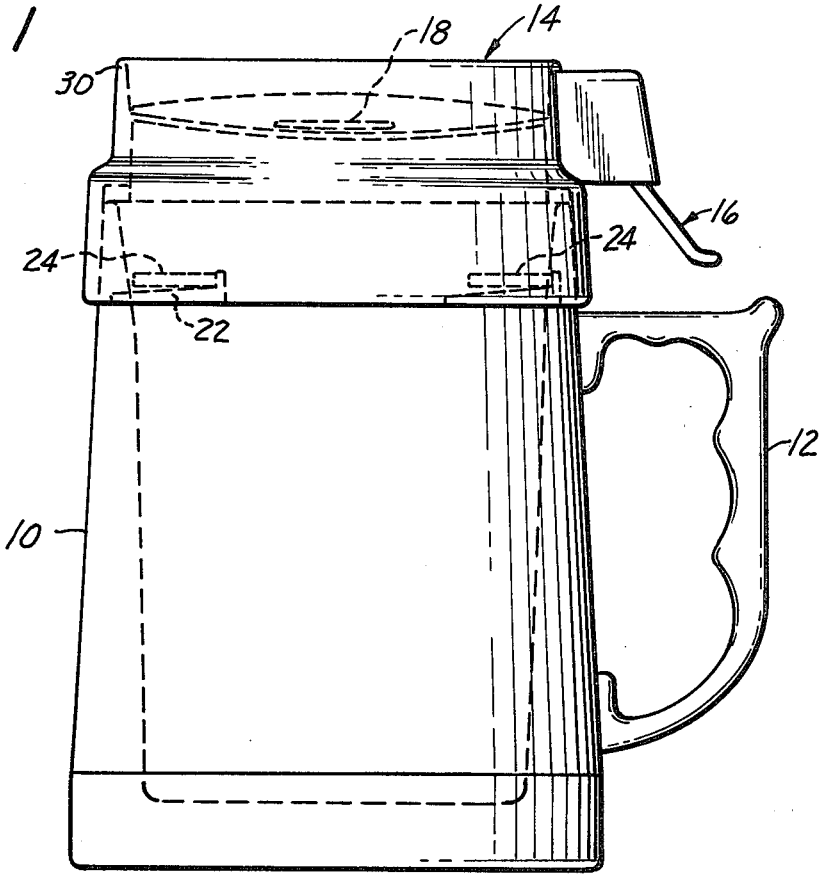
FIG. 1 is a side elevational view of an insulated drinking cup according to the invention.
Figure 2:
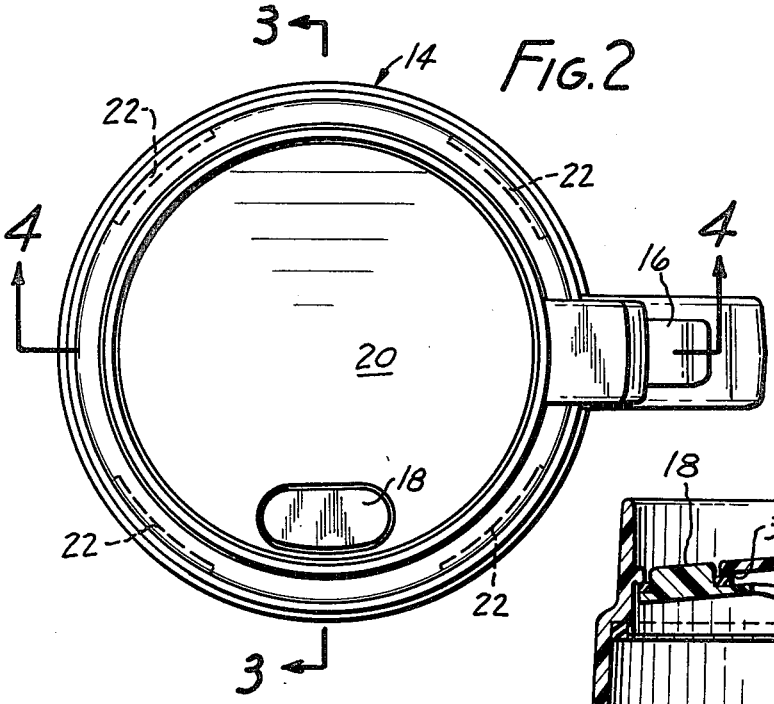
FIG. 2 is a top view of the drinking cup of FIG. 1.
Figure 3:
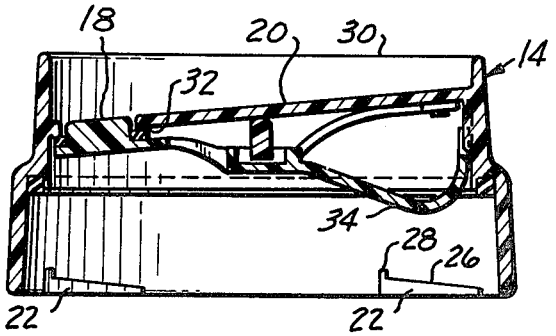
FIG. 3 is a sectional view of the cap used with the drinking cup taken at 3—3 of FIG. 2.
Figure 4:
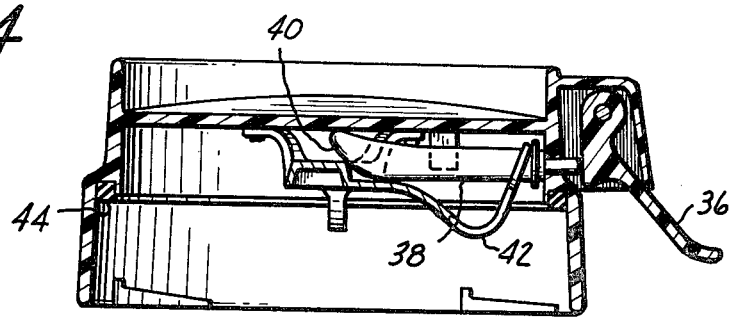
FIG. 4 is a sectional view of the drinking cup cap taken at 4—4 of FIG. 2.
Figure 5:
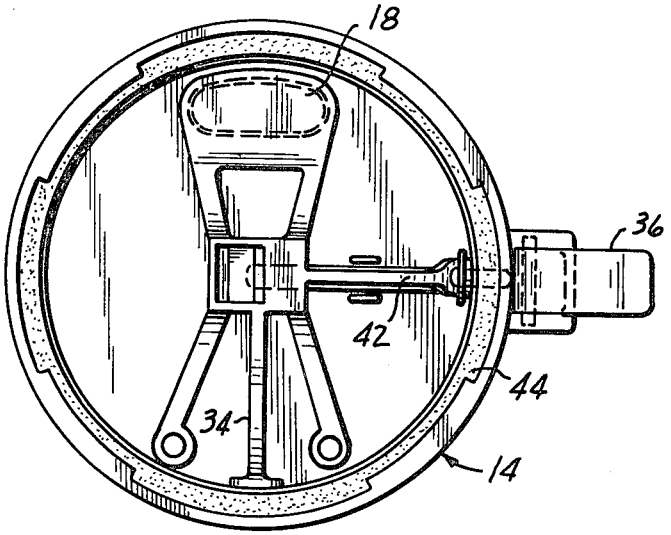
FIG. 5 is a bottom view of the cap for use with the insulated cap.

Referring now to FIG. 1 there is shown a cup 10, having a handle 12 and a removable cap 14. The cup 10 is insulated such as with foam or vacuum. The removable cap 14 when in the position shown, seals the contents of the cup, preventing spilling, and also maintaining the temperature of the contents. The cup 10 may be used with hot or cold fluids. The cap 14 has an actuator 16 positioned on the side for operating a valve 18 to release the contents of the cup. The actuator 16 is oriented relative to handle 12 by angled ridges 22 which engage a plurality of ridges 24 spaced around the outside peripheral surface of the cup 10. This forms a classical "bayonet" connection. In the preferred embodiment, four equally spaced locking ridges are provided. The ridges in the cap provide angled cam surfaces 26 engaging the ridges 24 on the cup and also include stops in the form of nubs 28 at the end of the ridges 22. Thus, when the cap is placed on the cup and given a twist the ridges 24 ride on the cam surface 26 of ridges 22 in the cap and abut against the stops or nubs 28, properly and accurately positioning the actuator for the valve 18 on the side adjacent to the handle. The cap 14 also includes a reservoir formed by an upward extending rim 30 surrounding a canted bottom 20 which directs any fluid left in the cap toward the valve 18 so it can flow back into the cup when the valve is opened.

Valve 18 has an oblong pad around which is a seal 32 which is biased against the inside surface of the cap 14 by flexible arm 34. Actuator 16 is comprised of a trigger 36 engaging a rod 38 having a cam surface 40 forcing the valve downward against the biasing of the arm 34. A second biasing arm 42 normally biases the rod 38 outward against the trigger 36 allowing the valve 18 to be in a normally closed position. Trigger 36 is laterally actuable.

The cap 14 is provided with a seal 44 which bears against the top edge of the cup to seal between the cap and the cup.

In use the container or cup 10 is filled while the cap is removed. The cap 14 is then placed on top of the cup and with a rotation or twist, the cap is locked by means of the ridges 22 engaging the ridges 24 on the cup. This seals the cup to prevent any spilling of the contents and also positions the valve actuator 16 within easy reach of the handle 12, thus when the user grasps the handle 12, the trigger 36 of the valve actuator is easy to operate with the thumb. The container then may be tipped up to drink and the actuator operated by the thumb, allowing the contents to pour through the valve 18. When the cup 10 is set down any fluid not consumed collects at valve 18 because of the canted surface 20. Thus actuation of the valve at this time enables the fluid collected in the reservoir to flow back into the container. The cup is simple and easy to use and provides insulation for hot or cold drinks, while at the same time it is convenient for use during traveling on boats, automobiles or any other type of vehicle.

This invention is not to be limited by the embodiment shown in the drawings and described in the description, which is given by way of example and not of limitation, but only in accordance with the scope of the appended claims.

I claim:

1. A mug type drinking receptacle with cover and valve assembly, including, in combination:

(a) a drinking receptacle having an open top and laterally extending handle on one side;

(b) a flat plate and surrounding rim defining a cup-shaped cover for closing off said open top of said receptacle, said plate having an opening adjacent to a first point of said rim, said receptacle and cover having inter-engaging means for removably securing said cover to said receptacle in a position in which said opening is circumferentially spaced 90° from said handle;

(c) a valve head beneath said opening in said plate having resilient support means secured to the bottom surface of said plate biasing the valve head upwardly against the bottom periphery of said opening to normally close said opening; and (d) an actuating member passing through a side opening in said rim beneath the undersurface of said plate at a point circumferentially spaced 90° from said opening so as to fall in vertical alignment with said handle, said member terminating in a camming surface engaging a portion of said valve head such that when said member is urged inwardly through said side opening in said rim, it cams said valve head away from said opening to thereby open the same so that a person can drink a beverage from said receptacle by holding said handle with one hand in the manner of a mug and operating said actuating member with the thumb.

2. An assembly according to claim 1, in which said plate is slightly tilted in said rim so that its top surface slopes upwardly from said first point of said rim to a second diametrically opposite point, and wherein said opening is elongated in a direction at right angles to a diametric line between said first and second points.

3. An assembly according to claim 2 in which a trigger is pivotally mounted to the rim of said plate and is rotatable to press against said actuating member to cause opening movement of said valve head.

4. An assembly according to claim 1 in which a trigger is pivotally mounted to the rim of said plate and is rotatable to press against said actuating member to cause opening movement of said valve head.

* * * * *